US008376695B2

(12) United States Patent
Scholz et al.

(10) Patent No.: US 8,376,695 B2
(45) Date of Patent: Feb. 19, 2013

(54) VARIABLE GEOMETRY VANE RING ASSEMBLY WITH STEPPED SPACER

(75) Inventors: Georg Scholz, Woellstein (DE); Richard Hall, Nebo, NC (US)

(73) Assignee: BorgWarner Inc., Auburn Hills, MI (US)

( * ) Notice: Subject to any disclaimer, the term of this patent is extended or adjusted under 35 U.S.C. 154(b) by 729 days.

(21) Appl. No.: 12/495,845

(22) Filed: Jul. 1, 2009

(65) Prior Publication Data

US 2010/0008766 A1 Jan. 14, 2010

Related U.S. Application Data

(60) Provisional application No. 61/079,567, filed on Jul. 10, 2008.

(51) Int. Cl.
*F04D 29/46* (2006.01)

(52) U.S. Cl. ..... 415/164; 415/214.1

(58) Field of Classification Search ..... 415/163, 415/164, 165, 206, 213.1, 214.1
See application file for complete search history.

(56) References Cited

U.S. PATENT DOCUMENTS 4,009,568 A * 3/1977 King et al. ..... 60/796
4,780,054 A * 10/1988 Yano et al. ..... 415/150
7,445,428 B2 * 11/2008 Baar ..... 415/164
7,670,107 B2 * 3/2010 Barthelet et al. ..... 415/160
7,918,023 B2 * 4/2011 Sausse et al. ..... 29/889.2
8,061,976 B2 * 11/2011 Hall ..... 415/160
2006/0062663 A1 * 3/2006 Figura et al. ..... 415/160
2006/0188367 A1 * 8/2006 Sterner et al. ..... 415/191
2006/0204362 A1 * 9/2006 Sterner ..... 415/191
2010/0008774 A1 * 1/2010 Scholz et al. ..... 415/209.3
2011/0038715 A1 * 2/2011 Frank et al. ..... 415/159

* cited by examiner

*Primary Examiner* — Ninh H Nguyen
*Assistant Examiner* — Liam McDowell
(74) *Attorney, Agent, or Firm* — William G. Anderson; Stephan A. Pendorf; Patent Central LLC

(57) ABSTRACT

A vane ring assembly includes a lower vane ring (20), an upper vane ring (30), one or more guide vanes (80) positioned at least partially between the vane rings, and a spacer (50) positioned between the lower and upper vane rings (20, 30) for maintaining a distance between the lower and upper vane rings (20, 30). The spacer has a first end (52) with a first diameter, a second end (54) with a second diameter, and a middle section (56) with a third diameter. The third diameter is larger than the first and second diameters. The first and second ends (52, 54) of the spacer (50) are inserted at least partially into a first counter bore (22) and a second counter bore (32) formed in the lower and upper vane rings (20, 30). A nut (40) and a fastener (42) running through a central through hole (58) of the spacer (50) are used to connect the vane ring assembly to a turbocharger housing. A clearance (c) of greater than e.g. 5% of the fastener diameter is formed between an inside wall (51) of the spacer (50) an outside wall (43) of the metal fastener (42) to offset any thermal expansion or deformation.

9 Claims, 19 Drawing Sheets

VARIABLE GEOMETRY VANE RING ASSEMBLY WITH STEPPED SPACER

FIELD OF THE INVENTION

This invention is directed to a turbocharging system for an internal combustion engine and more particularly to a design for allowing simplified assembly of components of the turbocharger as well as reduced deformation caused by thermal expansion.

BACKGROUND OF THE INVENTION

Turbochargers are a type of forced induction system. They deliver compressed air to the engine intake, allowing more fuel to be combusted, thus boosting the engine's horsepower without significantly increasing engine weight. This can allow for the use of a smaller turbocharged engine, replacing a normally aspirated engine of a larger physical size, thus reducing the mass and aerodynamic frontal area of the vehicle. Turbochargers use the exhaust flow from the engine to drive a turbine, which in turn, drives the air compressor. At startup, the turbocharger may be at temperatures well below 0° C. Since the turbine spins at extremely high speed, in the range of 150,000 RPM to 300,000 RPM, is mechanically connected to the exhaust system, it sees high levels of temperature, up to 1050° C. for a gasoline engine, and vibration. Such conditions have a detrimental effect on the components of the turbocharger. Because of these adverse conditions the design, materials and tolerances must be selected to provide adequate life of the assembly. The design selections, required to satisfy these conditions, often lead to larger than preferred clearances, which, in turn, cause aerodynamic inefficiencies. Further, the flow of exhaust gasses impart rotational torque on the vane assembly, which must be prevented from rotation by mechanical securing means.

Turbochargers, which utilize some form of turbine flow and pressure control are called by several names and offer control though various means. Some have rotating vanes, some have sliding sections or rings. Some titles for these devices are: variable turbine design (VTG), variable geometry turbine (VGT), variable nozzle turbine (VNT), or simply variable geometry (VG). The subject of this patent is the rotating vane type of variable turbine, which will be referred to as VTG for the remainder of this discussion.

VTG turbochargers utilize adjustable guide vanes FIG. 1 (80), rotatably connected to a pair of vane rings (30), (20) and/or nozzle wall. These vanes are adjusted to control the exhaust gas back pressure and the speed and amount of exhaust gas flow to the turbine wheel. VTG turbochargers have a large number of components that must be assembled and positioned in the turbine housing so that the guide vanes remain properly positioned with respect to the exhaust supply channel and the turbine wheel over the range of thermal operating conditions to which they are exposed. A typical VTG turbocharger FIG. 17 employ three metal fasteners (111, 112, 113) which are either studs, bolts, or studs with nuts, to secure the vane ring assembly (e.g., the vane ring and guide vanes) to the turbine housing (100) so that the turbine housing assembly surrounds the vane ring assembly. This typical assembly utilizes spacers with flat ends which makes them free to control the distance between the lower vane ring (20) and the upper vane ring (30) in the assembled state, but which also is a problem at assembly as they are free to fallout of the assembly.

The connection of such an assembly to the turbine housing produces several important issues: The parallelism of the assembly to the turbine housing (see FIG. 12). Vane rings (20) and (30) must be parallel to the turbine housing (100). The vanes (80) must be placed such that the vane cheek surfaces (81) are adjacent to and parallel to the upper and lower vanes rings. The turbine housing machined face (101) must be machined in the correct axial location for the vanes to line up with the turbine flow.

The angular location of the vane ring assembly to the turbine housing datum (126), is set by aligning the datum pin (126) (FIG. 9), with the centerline of the turbine housing set by a radius (125), and the coordinate dimensions (124) of the pin drilling. These dimensions determine the X-Y-Z location of the vane assembly to the turbine housing.

The effect of temperature on the turbine housing results in both thermal expansion (at the rate of the coefficient of thermal expansion for the iron or steel of the turbine housing or respective part being heated) influenced by the thermal flux caused by the flow path of the exhaust gas, which is additionally influenced by the geometry and wall thickness of the turbine housing. The inherent nature of a turbine housing under thermal influence is for the "snail section" to try to unwind from its cold shape and position. This often results in a twisting motion, dependent upon the constraints of the casting geometry. Unconstrained, by attachment to the turbine foot, gussets or ribs, the turbine housing large apertures, which are cold at room temperature, assume an oval shape at operating temperature.

This relatively simple thermal expansion, combined with the results of the geometric and thermal flux influences, results in complex motion of the turbine housing across the temperature range.

When an assembly, such as the vane ring assembly, is mounted to the turbine housing wall as in FIG. 1, (8), FIG. 4 (13), the studs or bolts will assume the motion of said wall, albeit in a manner somewhat perpendicular to said wall. So when the turbine housing wall moves due to thermal influences, the mountings will mimic that movement. In FIG. 8, which is a simplified depiction of the method for mounting the fasteners into the turbine housing, the fasteners (111), (112), (113) are each held in perpendicular position by the tapped holes (136), (134), (137) in the turbine housing (100), at the turbine housing lower vane mounting face location.

The fasteners (111), (112), (113) are held in both X-Y and angular position by the placement of the tapped holes. The relative position of each hole, to the center of the turbine housing, is determined by the coordinate X-Y positions of each hole, (136), (134), (137) to the coordinate position of the turbine housing center (120), and the angular position by the relationship of the set of the three holes to a datum (126) (see FIG. 9).

FIG. 10 shows the effect, perpendicular to the turbine housing mounting surface, of a simple case of distortion in the turbine housing mounting face. In this case the base position (136), (134), (137) of the fasteners, on pitch circle diameter (PCD) (130) FIG. 9, changes a small amount due to the change from flat to curved of the turbine housing mounting face (100). It can be seen in FIG. 10 however that the dimension "A" (135) at top end of the fasteners (111), (112), 113) moves considerably more, than does the dimension "B" (138) at the bottom end of the fasteners. It can be seen in FIG. 11, that the angular position of the fasteners (111, 112, 113), relative to the datum (126) stays approximately constant, while the perpendicular orientation moves in reply to the turbine housing mounting face distortion. In a like manner the distortion of the turbine housing could be convex, instead of concave, which would result in the dimension, at the top end of the fasteners "A" (135), moving in a direction which produces a top end dimension being less than the bottom end dimension "B" (138). The important thing is the deformation and motion, not the direction of deformation, and resultant motion.

This displacement of the fastener causes distortion in the vane rings, which then causes the vanes and moving components to stick. If the clearances between components are loosened in order to reduce the distortion in the vane ring, the excessive clearances cause a loss of aerodynamic efficiency, which is unacceptable. The clearance between vane side faces, and their partner vane ring side faces is especially critical to aerodynamic efficiency. The displacement of the fasteners also generates high stress in the fastener, which results often in failure of the fastener. Unusual wear patterns, due to distortion in the vane ring, also generate unwanted clearances, which further reduce the aerodynamic efficiency.

Tapped holes are a very efficient manufacturing method but are simply not effective when it comes to dimensional accuracy or repeatability. While it is normal practice to generate acceptable accuracy and repeatability with drilled or reamed holes, the threading activity is fraught with problems. The threaded region of both the fastener and the hole has to be concentric with the unthreaded zone of the shaft and hole in order to place the fastener in the appropriate X-Y position with respect to the hole. By the very nature of threads it is usual for the male feature to lose its perpendicularity to the female feature (and vice versa) as increased torque applied to the fastener rocks the un-torqued portion of the fastener towards the thread angle, which has the effect of tipping the fastener, in the case of a male stud or bolt in a female hole, away from perpendicular to the threaded surface plane.

In U.S. Pat. No. 6,558,117 to Fukaya, a VTG turbocharger is shown having a vane ring assembly integrally connected to the turbine housing via bolts. The Fukaya device is shown in FIG. 2 and a second embodiment is shown in FIGS. 3 and 4, and has a turbine casing (1), rotatable guide vanes (2), a flow passage spacer (3), a bill-like projection portion (4) and a turbine rotor (5). Each of the guide vanes (2) is supported by a rotational shaft (7) extending outward of a guide vane table (6). A bolt (8) extends through the guide vane table (6) and the flow passage spacer (3), and is fastened to the casing (1).

To account for thermal deformation of the casing (1) and the guide vane table (6), an outer diameter of the Fukaya flow passage spacer (3) must be set to about 9 mm. Fukaya also uses material selection to combat thermal expansion. A material having the same coefficient of linear expansion as that of the guide vanes (2) (for example, SCH22 (JIS standard)) is employed for a material of the flow passage spacer (3) and the bolt (8). A width $h_s$ of the flow passage spacer (3) is designed to be slightly larger than a width $h_n$ of the guide vanes (2), and an attempt is made to minimize the gap between both of the side walls of the casing (1) and the guide vane table (6) sectioning the turbine chamber, and the guide vanes (2).

Due to the integral connection of the housing (1) with the vane table (6), the Fukaya turbocharger suffers from the drawbacks of having to allowing gaps to account for thermal growth. Such gaps reduce the performance of the turbocharger. The Fukaya turbocharger also requires the use of material with low thermal coefficients of expansion. Such materials can be costly and difficult to work with.

Fukaya further proposes another embodiment of the variable geometry turbocharger as shown in FIGS. 3 and 4. Three bolts (13) each having an outer diameter of 5 mm are arranged at positions uniformly separated into three portions in a peripheral direction. The bolt (13) extends through a portion of the guide vane table (6) that extended to the casing (I ) side and fastens the guide vane table (6) to the casing (1). A heat resisting cast steel HK40 (ATSM standard) having a little amount of carbon is employed for a material of the casing (1), the guide vane table (6) and the guide vane (2). A distance between both of the side walls of the casing (1) and the guide vane table (6) is defined by $h_a$-$h_b$, and is designed to be slightly larger than the width $h_n$ of the guide vane (2).

While this second embodiment of Fukaya removes the fasteners from the flow path, it still provides an integral connection of the housing (1) with the vane table (6), which will result in the transfer of stresses and/or growth from the casing to the vane ring components. The Fukaya turbocharger also requires the use of material with low thermal coefficients of expansion. Such materials can be costly and difficult to work with.

In U.S. Pat. No. 6,679,057 to Arnold, a variable turbine and variable compressor geometry turbocharger is described as shown in FIG. 5. Each of the turbine vanes is connected to the turbine housing via a vane post. The vane post is inserted into a correspondingly sized hole in the turbine housing. The Arnold device also suffers from the drawback of radial thermal expansion of the turbine housing imparting undue stress and/or movable components "sticking" due to the use of the vane post connection in the housing.

In U.S. Pat. No. 7,021,057 B2 to Sumser, an exhaust-gas turbocharger with a VTG vane structure is described as shown in FIG. 6 in which spacer bushes (21 ) are provided to ensure that there is a defined minimum distance between the outer support wall (11) and the inner support wall (14). The variable turbine vane structure is fixed by means of bolts (22), which extend between the end section (17) of the support wall (14) and the support wall (11). Also here, the vane ring components will suffer thermal stresses imparted by the turbine housing due to the fixed structure.

U.S. Pat. No. 5,186,006 to Petty, references cross cut keys as a method for the mounting of a ceramic shell defining a turbine housing onto a metal engine block using a set of ceramic cross cut keys connected to a second set of cross cut keys on a metal spider bolted to the engine block.

U.S. Pat. No. 6,287,091 to Svihla et al, references radial keys and guides to be used in aligning the nozzle ring of an axial turbocharger for a railway locomotive.

FIG. 21 depicts the centering drive from a Cosworth DFV, or DFX racing engine. These engines were first produced in 1967 and have been in general production for some 40 years. This drive mechanism is used to provide drive to the oil and water pumps on the sides of the engine, irrespective of the thermal conditions of either pump. The temperature of the fluids in the pumps cause the pumps to expand or contract against the engine block, thus changing the centerlines of the pumps, relative to the driving flange which is also solidly mounted to the engine block, albeit under a different set of thermal conditions. So in most cases the center of the flanges is not concentric with its mating flange, but the design enables a vibration free drive to take place.

In this design (FIG. 21) the driving flange (182) is screwed onto a driving shaft (187) connected by belt drive to the engine crankshaft. The driving flange features a radial male key (186), which engages into a female radial slot (185) in the cross-key coupler (180). In this embodiment of the cross-key design, the coupler has two diametral female slots (184, 185) at an angle of 90° to each other. The driven flange (181) features a male key (183) machined into its face. The male key engages in the female slot (184) in the coupler (180). The coupler (180) is held in axial position only by the proximity of the driving, and driven, flanges. The coupler (180) is held in radial position by the action of the two mating keys and keyways in the opposing flanges. Thus the coupler (180)

provides a centerline drive from the driving flange (182) to the driven flange (181).

In this section, any reference to a paragraph number of the present application is made with respect to the paragraph numbers in the published version of the present application—US 2010/0008766 A1 (Jan. 14, 2010).

Thus, there is a need for a fastening system and method for connecting the vane ring assembly to the turbine housing. There is a further need for such a system and method that accounts for thermal growth of the housing and/or vane ring assembly while maintaining efficiencies. There is a yet a further need for such a system and method that is cost effective and dependable. There is a need for a need for a system of parts that allows elimination of costly stud bolts. There is additionally a need for such a system and method that facilitates manufacture, assembly and/or disassembly.

SUMMARY OF THE INVENTION

The exemplary embodiments of the vane ring assembly effectively decouple the assembly from the turbine housing and eliminate the potential for vanes to stick due to relative movement through thermal growth, as is experienced when the lower and upper vane support rings are rigidly affixed to each other and the turbine housing via studs, bolts, and the like. The exemplary embodiments provide a fastening system and method for connecting the vane ring assembly to the turbine housing that negates the effect of thermal growth of the housing and/or vane ring assembly while maintaining efficiencies. The exemplary embodiments are cost effective and dependable, and are designed for assembly and/or disassembly.

More specifically, a mechanical fit between stepped spacers and bores (preferably stepped bores) in the vane rings forms a stable structure with rigid fixation of upper and lower vane rings. Thereby, as illustrated by one specific embodiment in FIG. 15, (a) the vane rings are substantially decoupled from influence of thermal warpage or distortion of the turbine housing, and (b) so long as the washer (44) or contact surface has a suitable size so that it can minimize surface load of the nut (40), and there is a gap between metal fastener outer diameter and bearing spacer inner diameter, the vane ring assembly can expand and contract radially thereby accommodating thermal expansion and contraction. Since the upper and lower vane rings remain in constant alignment, the vanes, which are mounted on one or both vane rings, remain aligned for proper pivoting.

BRIEF DESCRIPTION OF THE DRAWINGS

The present invention is illustrated by way of example and not limitation in the accompanying drawings in which like reference numbers indicate similar parts, and in which.

DETAILED DESCRIPTION OF THE INVENTION

Figure 18:
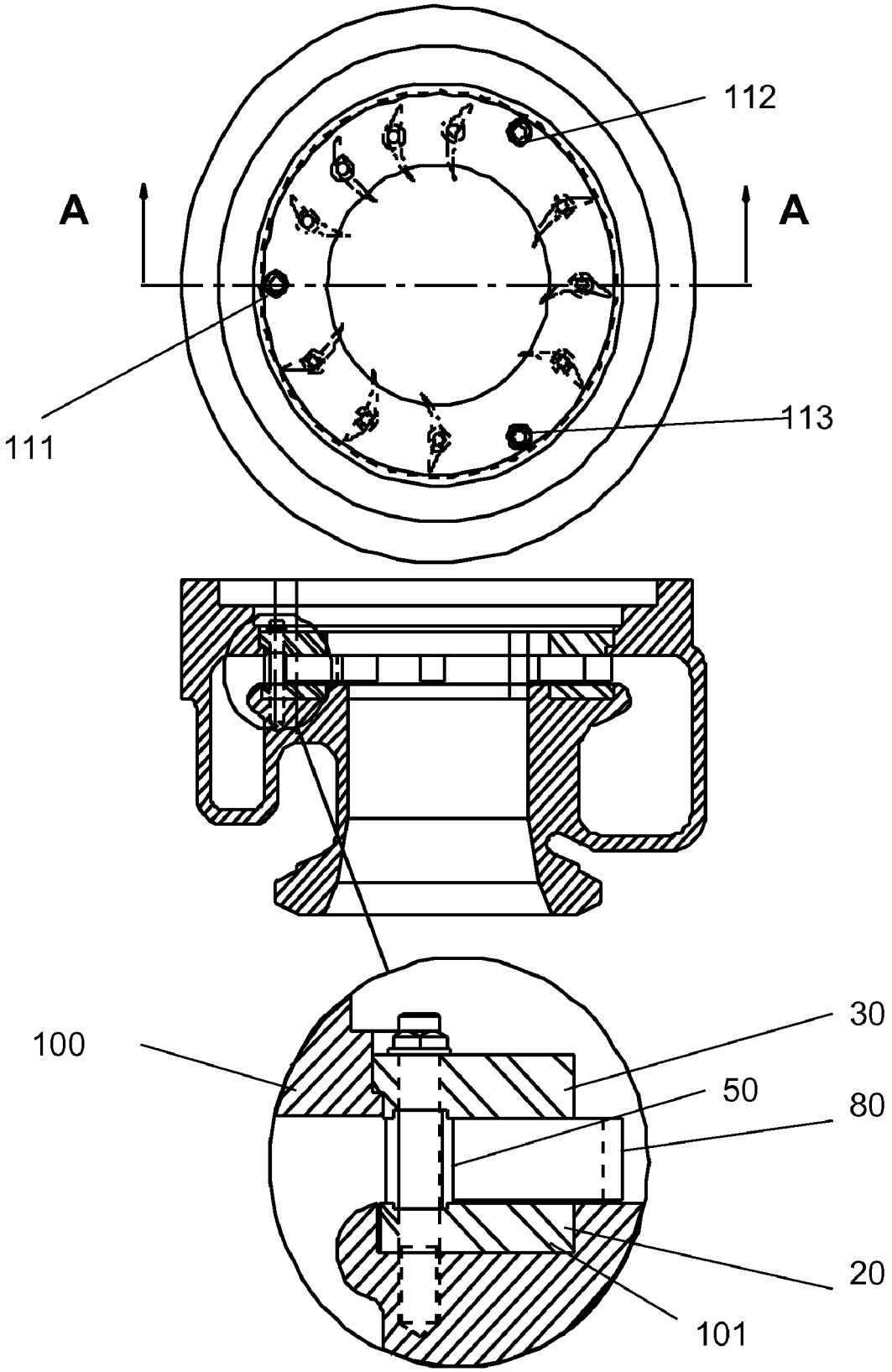
FIG. 18 is the plan view, with an elevation, and a magnified zone, of a typical fastener and a stepped spacer arrangement in a turbine housing section.

The invention will now be described by reference to illustrative embodiments. FIG. 18 shows a turbine portion (100) of a turbocharger, in which a plurality of guide vanes (80) are positioned between a lower vane ring (20) ("LVR") and an upper vane ring (30) ("UVR"). The guide vanes (80) are rotatably movable to control the amount of exhaust flowing into the turbine. The distance between the supporting rings (20), (30) is maintained by a spacer (50) positioned between them. The lower and upper vane rings (20), (30) are connected to the turbine housing (100) by a nut (40) and a metal fastener (42). The metal fastener can take the form of a stud, bolt, or any other metal fastener used in the mechanical arts. A washer (44) can be placed between the nut (40) and the second support ring (30). The washer (44) has a suitable size so that it can minimize surface load of the nut (40) to allow the system to move.

Figure 1:
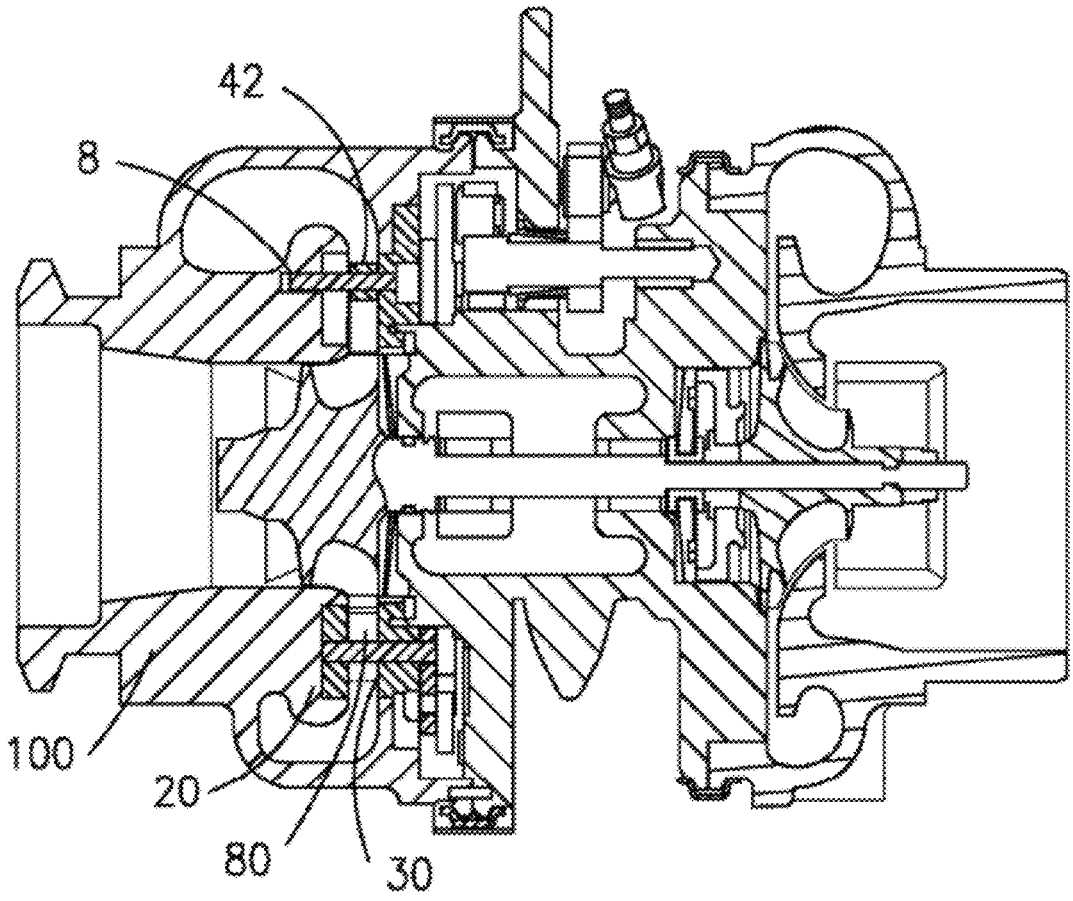
Fig. 1 Prior Art
FIG. 1 is a cross sectional view of a typical VTG turbocharger.
Figure 2:
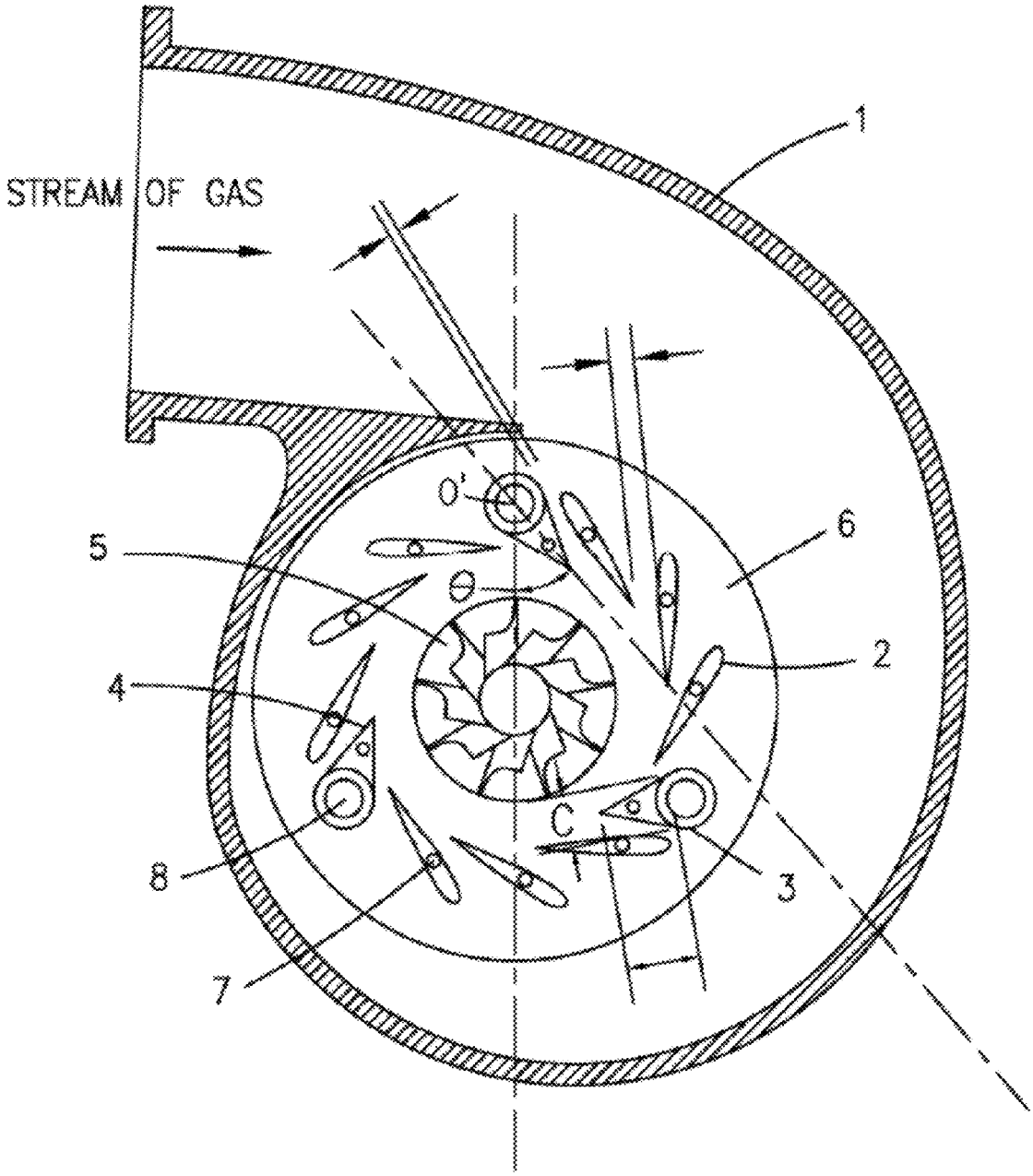
Fig. 2 Prior Art
FIG. 2 is a cross-sectional view of a turbine portion of a contemporary turbocharger system according to U.S. Pat. No. 6,558,117.
Figure 3:
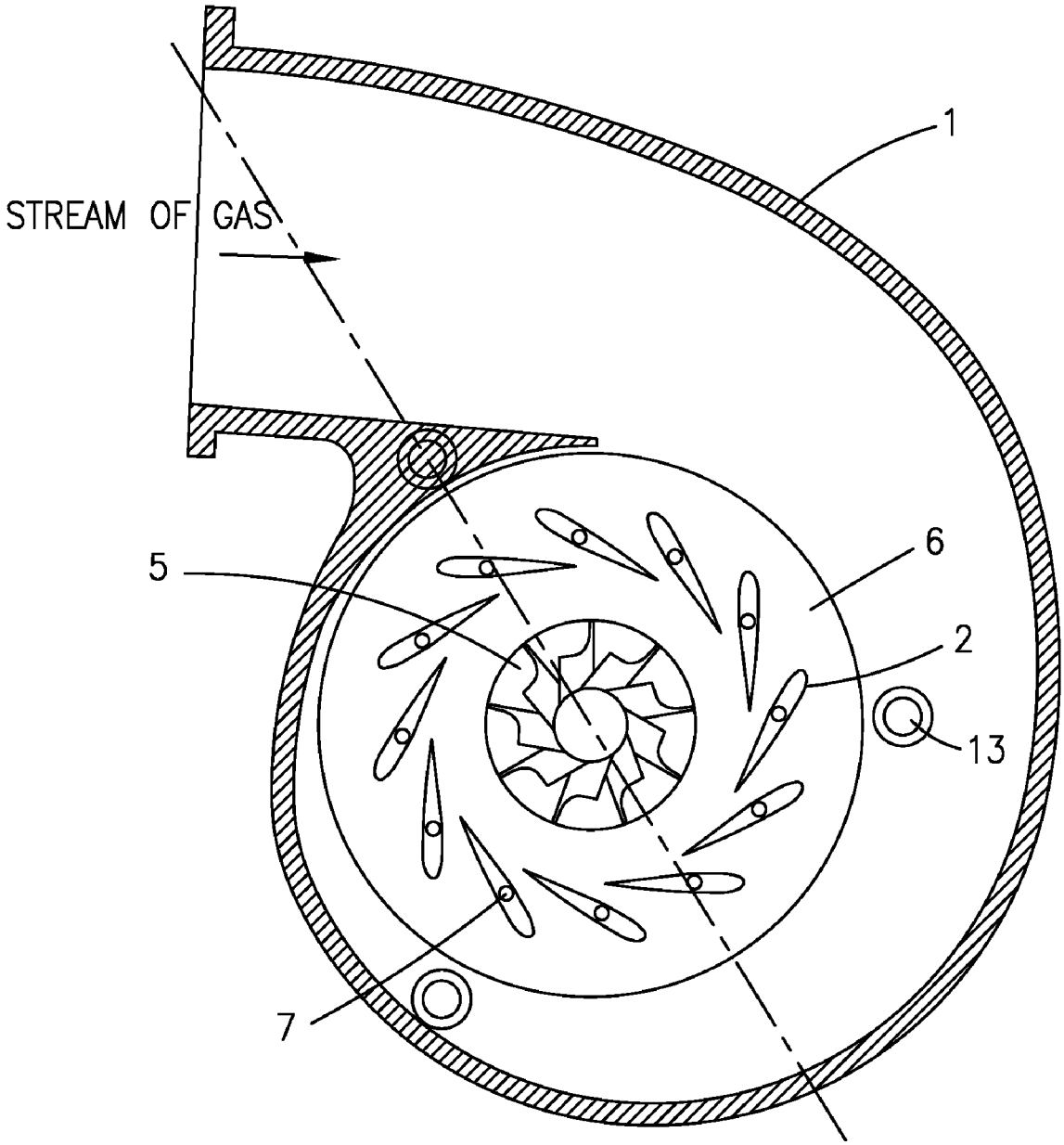
Fig. 3 Prior Art
FIG. 3 is a cross-sectional view of a turbine portion of another contemporary turbocharger system according to U.S. Pat. No. 6,558,117.
Figure 4:
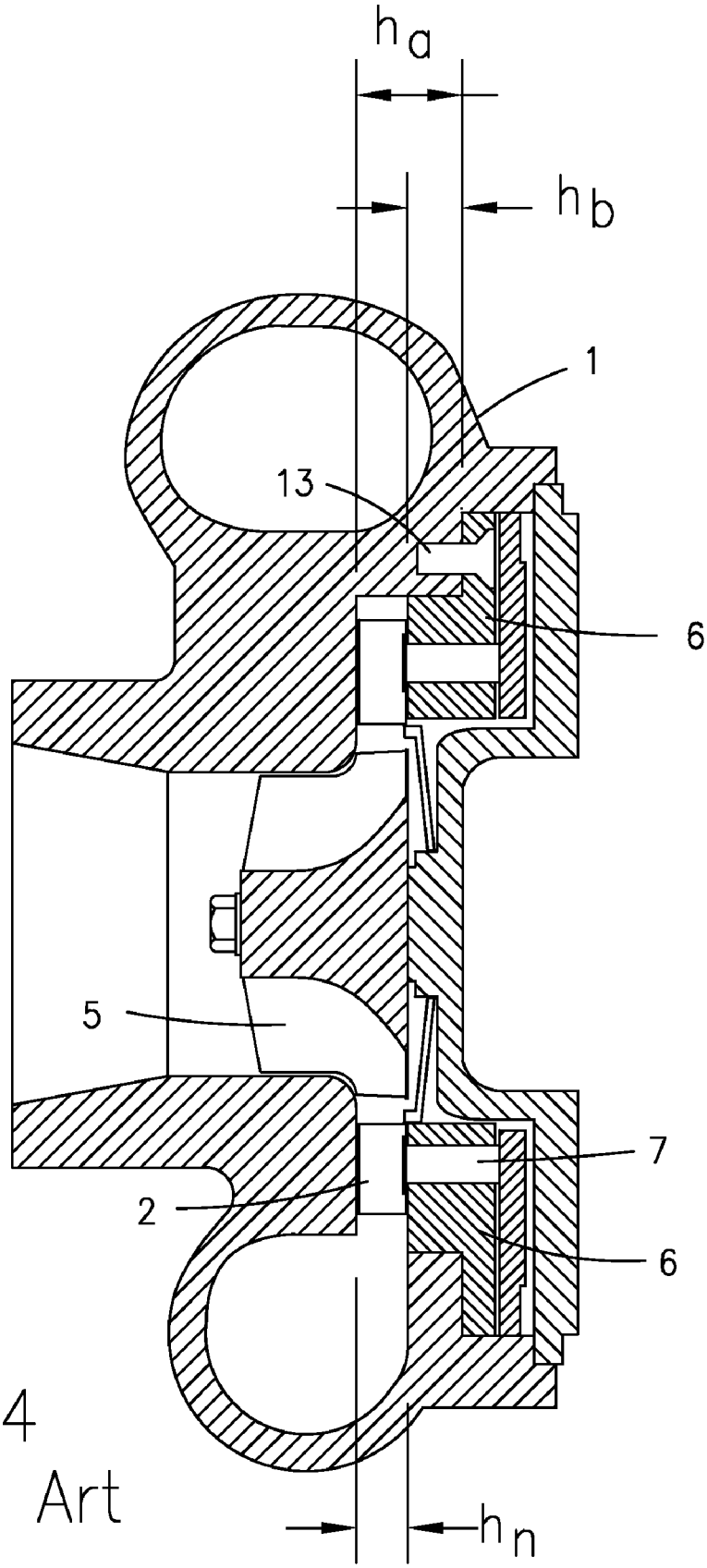
Fig. 4 Prior Art
FIG. 4 is an enlarged cross-sectional view of a portion of the contemporary turbine portion of FIG. 3.
Figure 5:
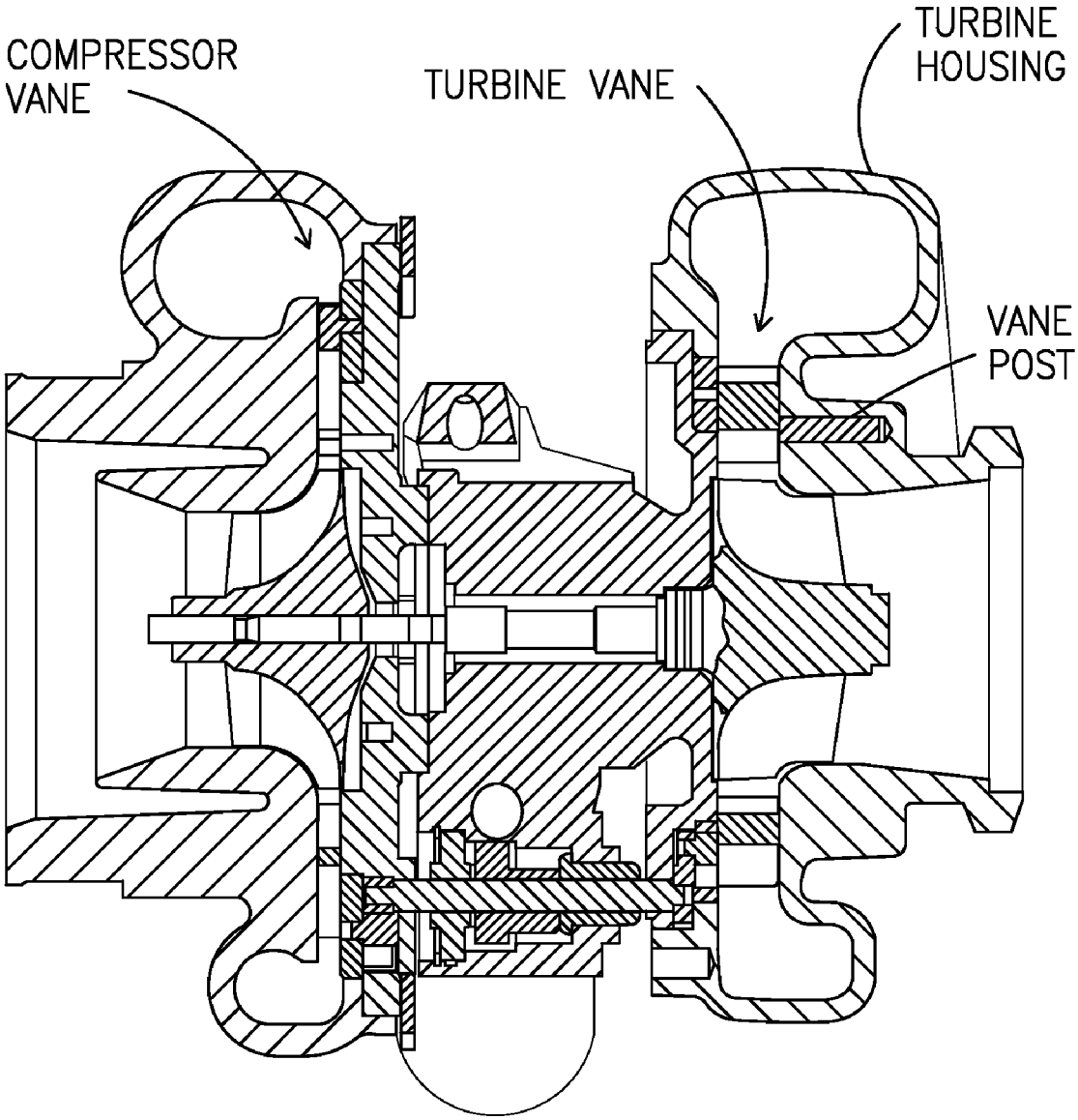
Fig. 5 Prior Art
FIG. 5 is a cross-sectional view of a turbine portion of another contemporary turbocharger system according to U.S. Pat. No. 6,679,057.
Figure 6:
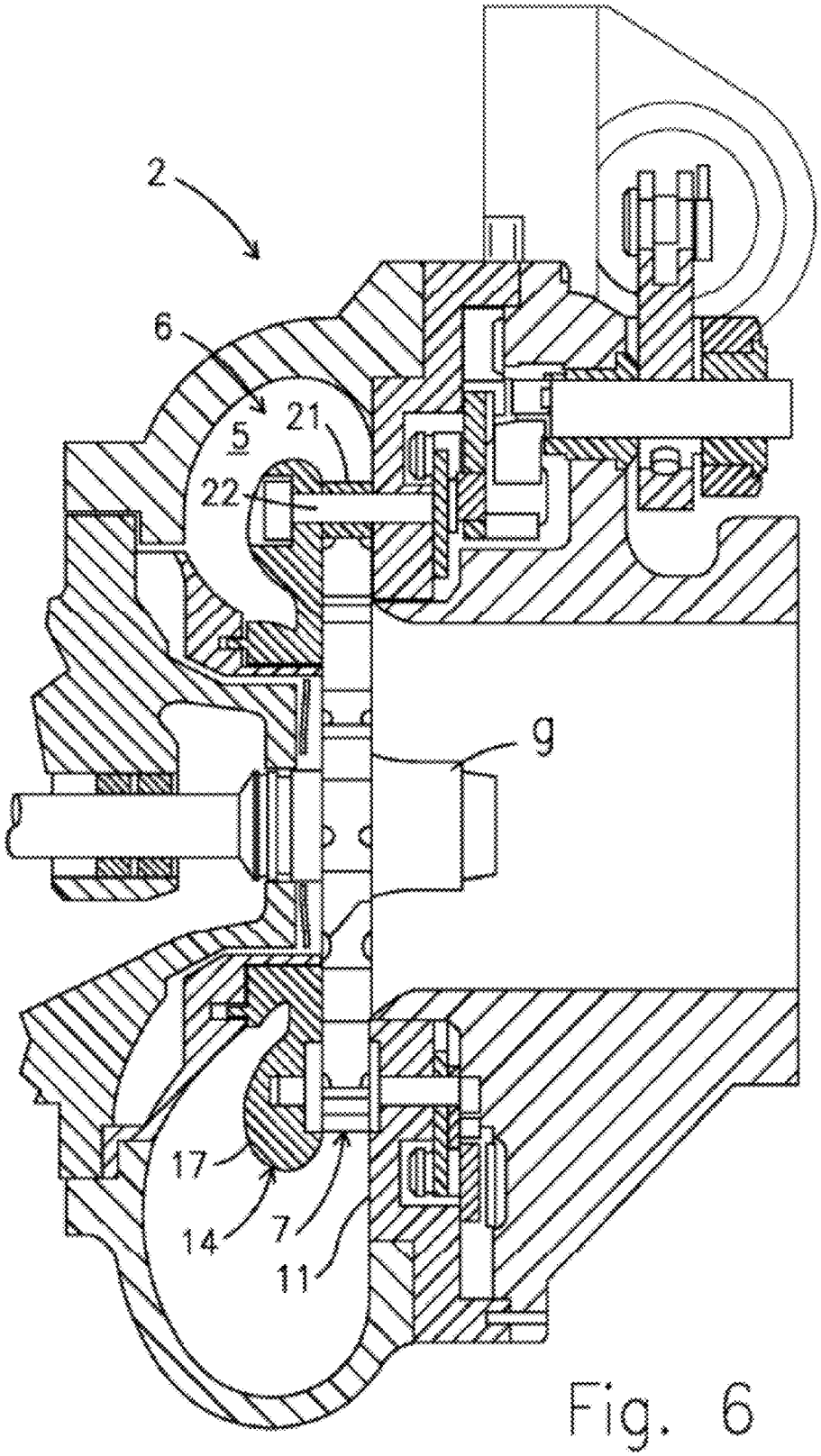
Fig. 6 Prior Art
FIG. 6 is a cross-sectional view of a turbine portion of another contemporary turbocharger system according to U.S. Pat. No. 7,021,057.
Figure 7:
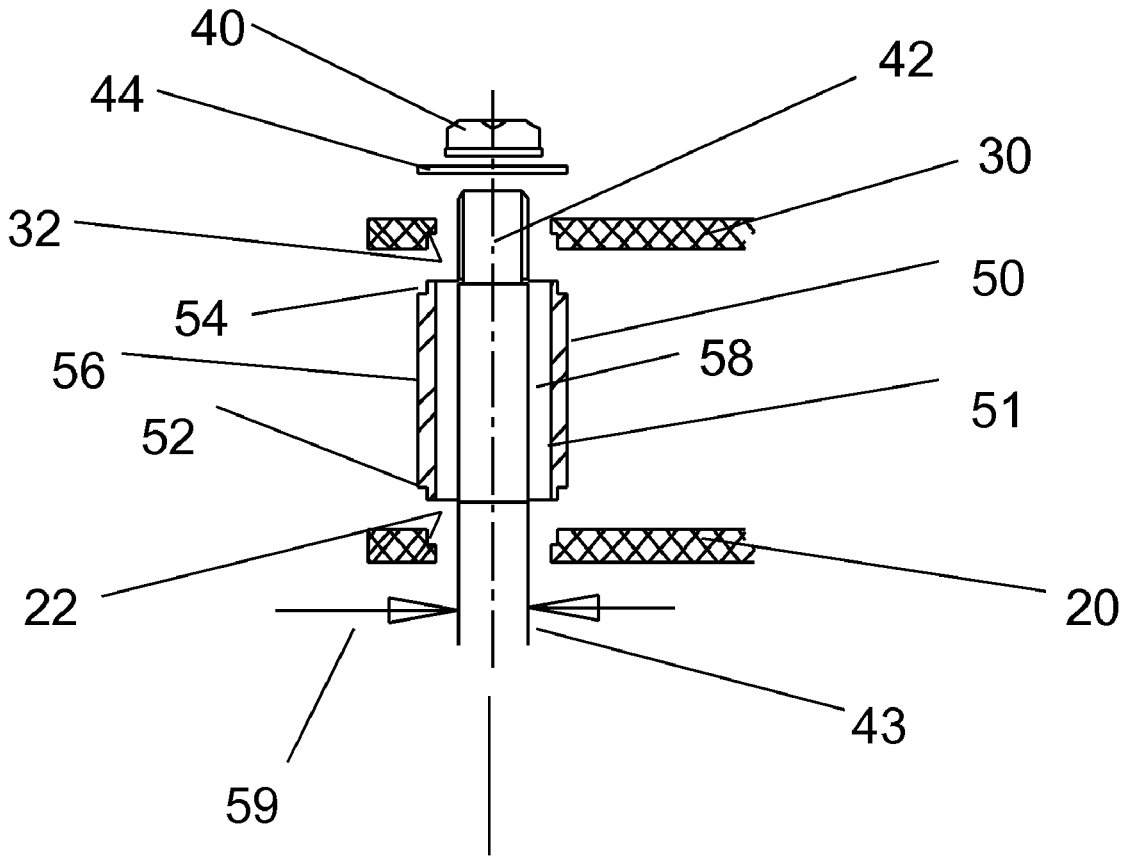
FIG. 7 is an enlarged cross-sectional view of a the interface between a stepped spacer and the vane rings.
Figure 8:
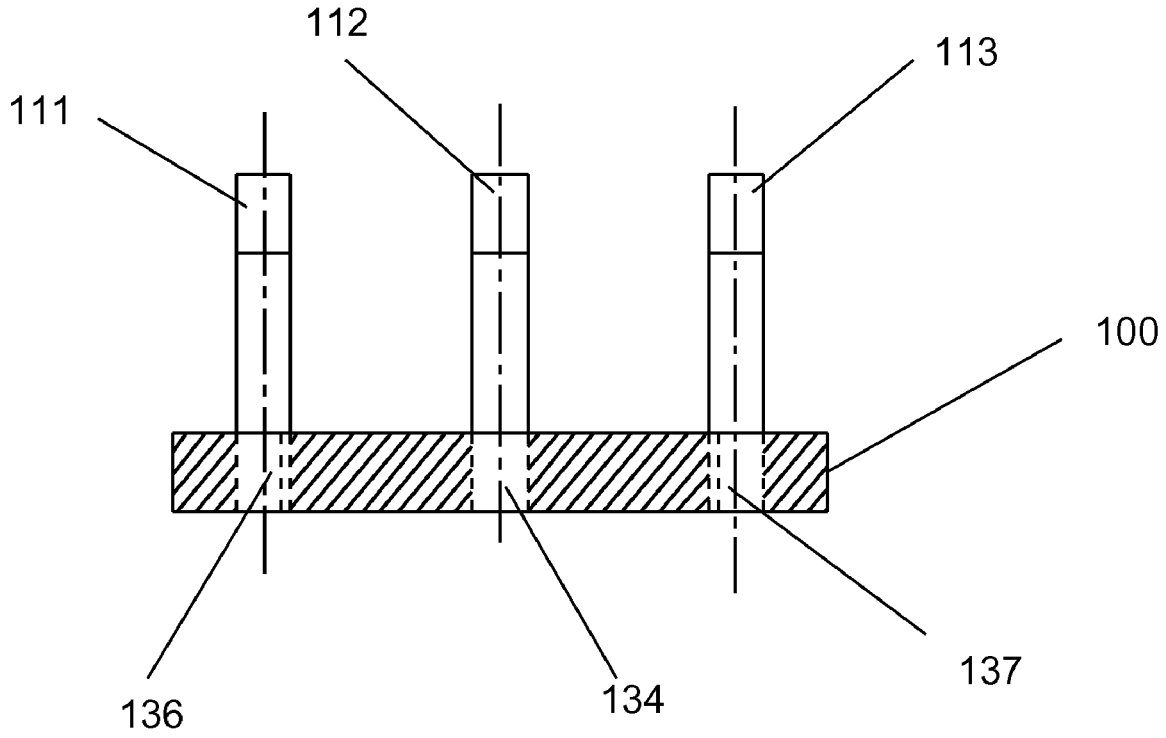
FIG. 8 is a simplified view of the fasteners and a section of the turbine housing.
Figure 9:
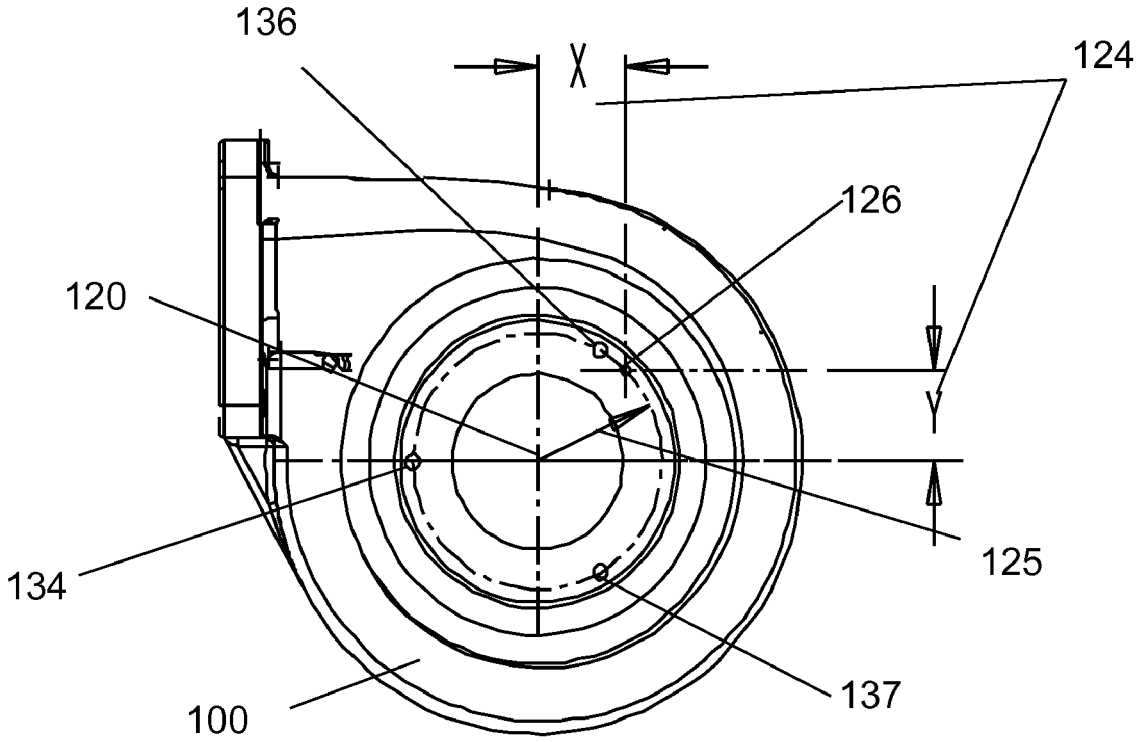
FIG. 9 is a plan view of the tapped hole locations for the fasteners in a turbine housing.
Figure 10:
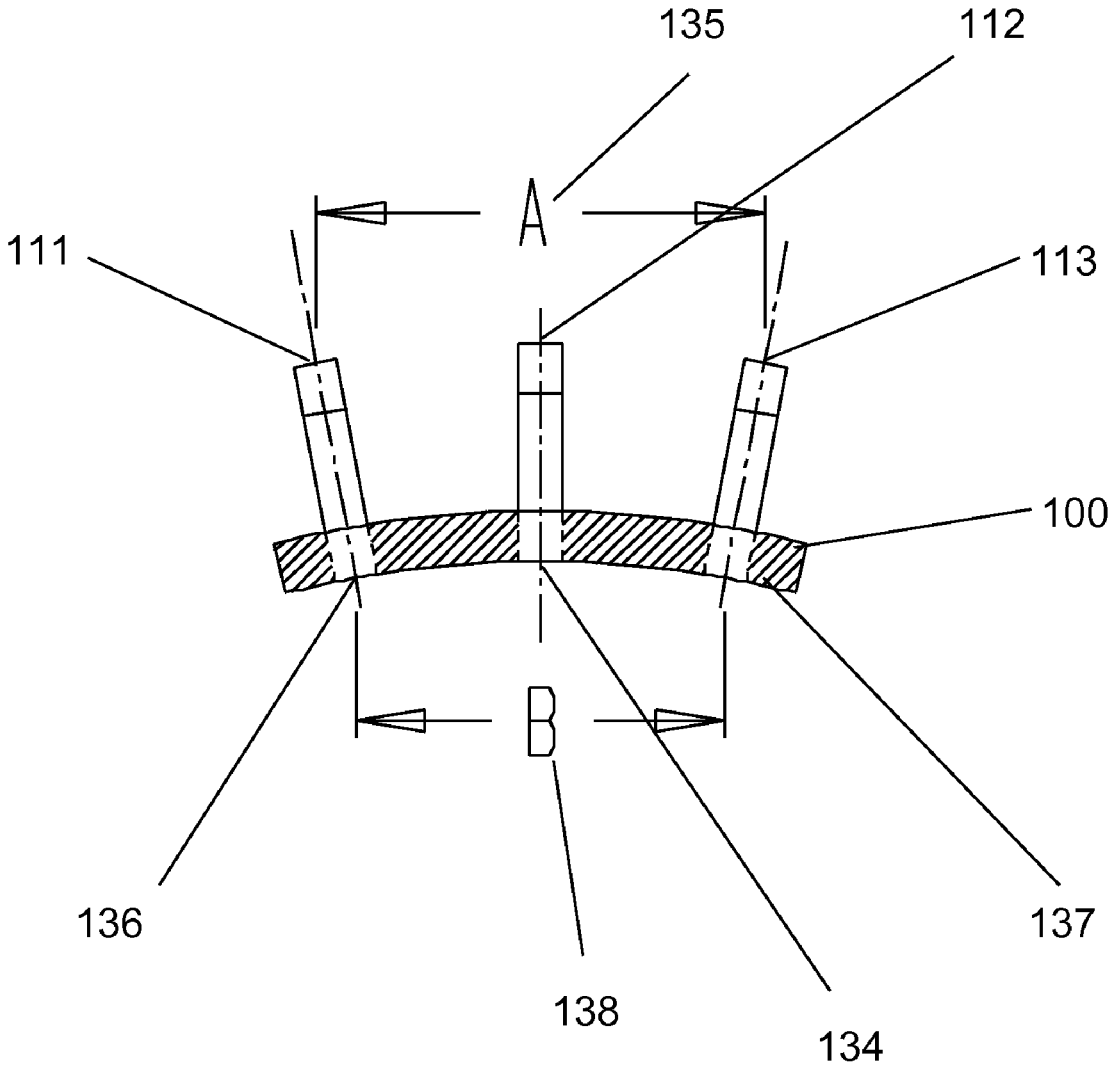
FIG. 10 is a simplified front elevation, cross sectional view of the arrangement in FIG. 8 subjected to a simplified case of thermal distortion.
Figure 11:
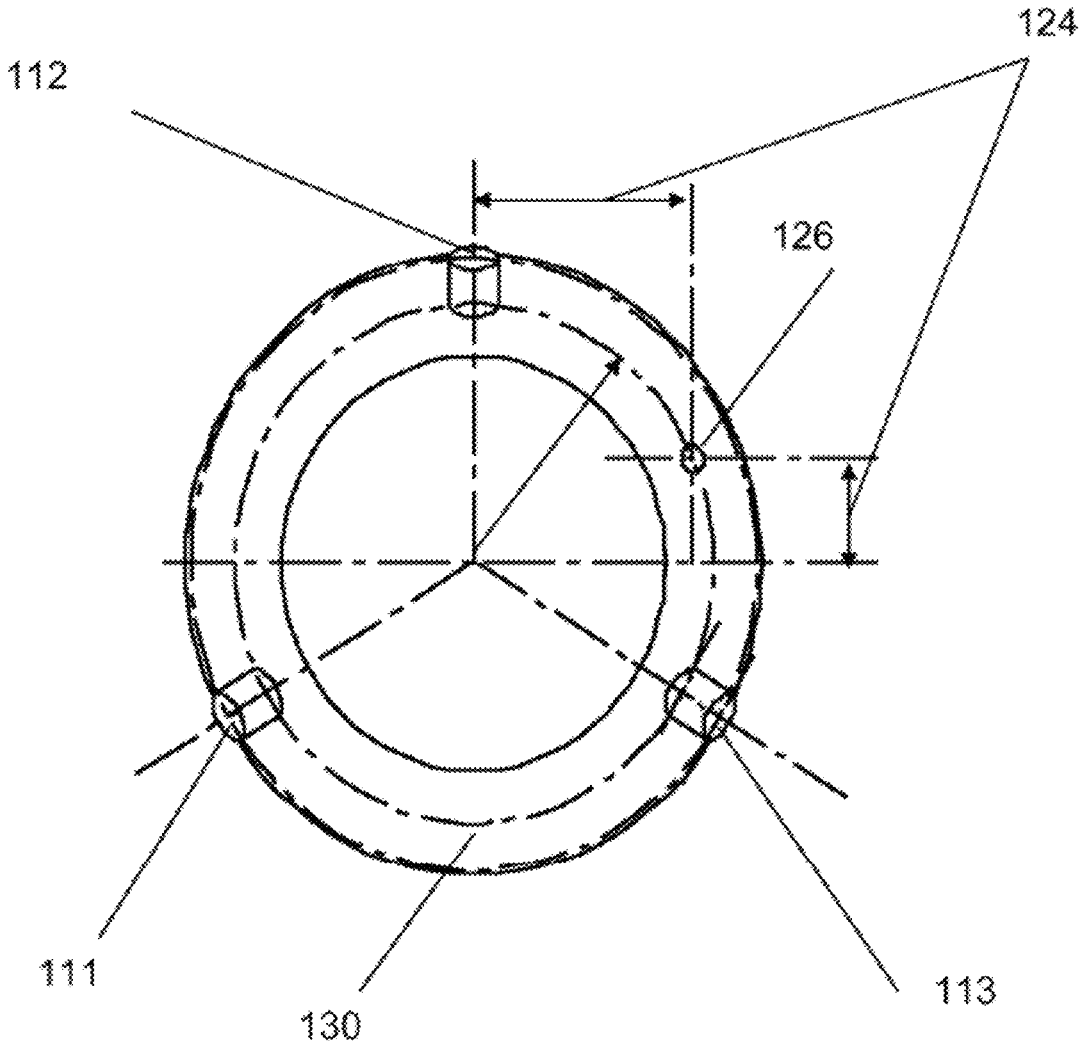
FIG. 11 is a plan view of FIG. 10, subjected to a simplified case of thermal distortion.
Figure 12:
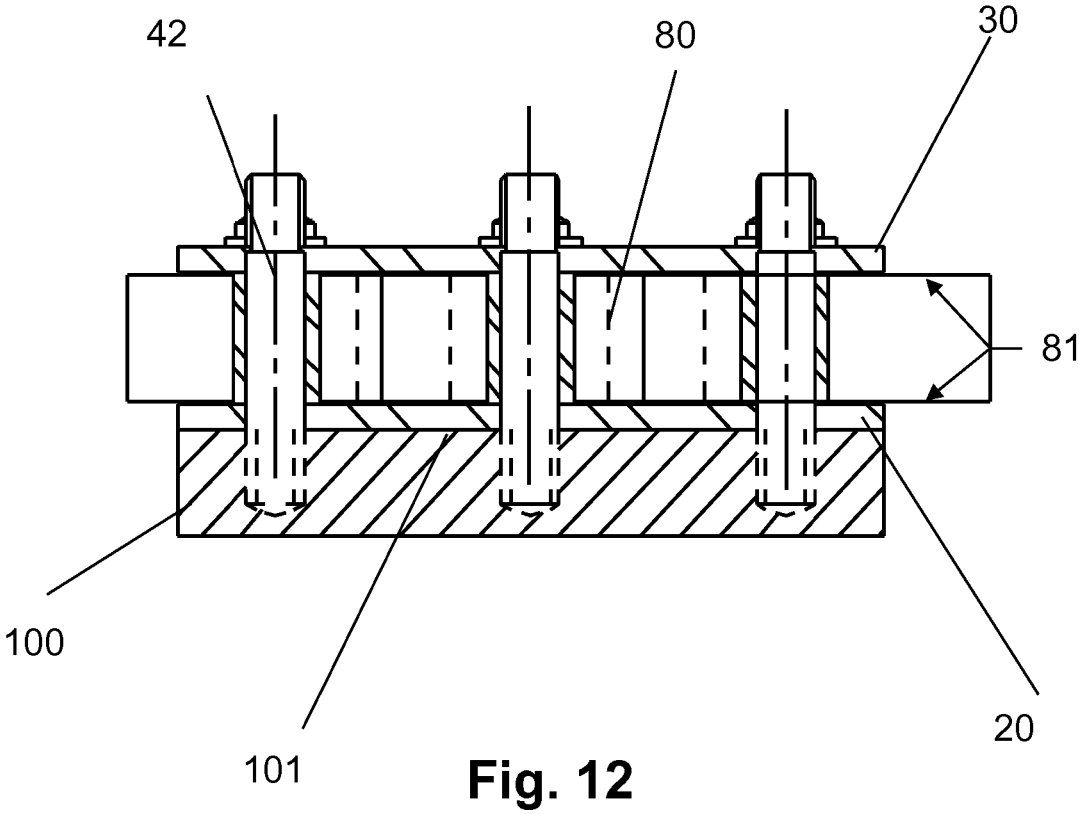
FIG. 12 is a simplified cross sectional elevation of FIG. 8, with the vane rings, simple, non-stepped spacers, washers and retaining nuts added.
Figure 13:
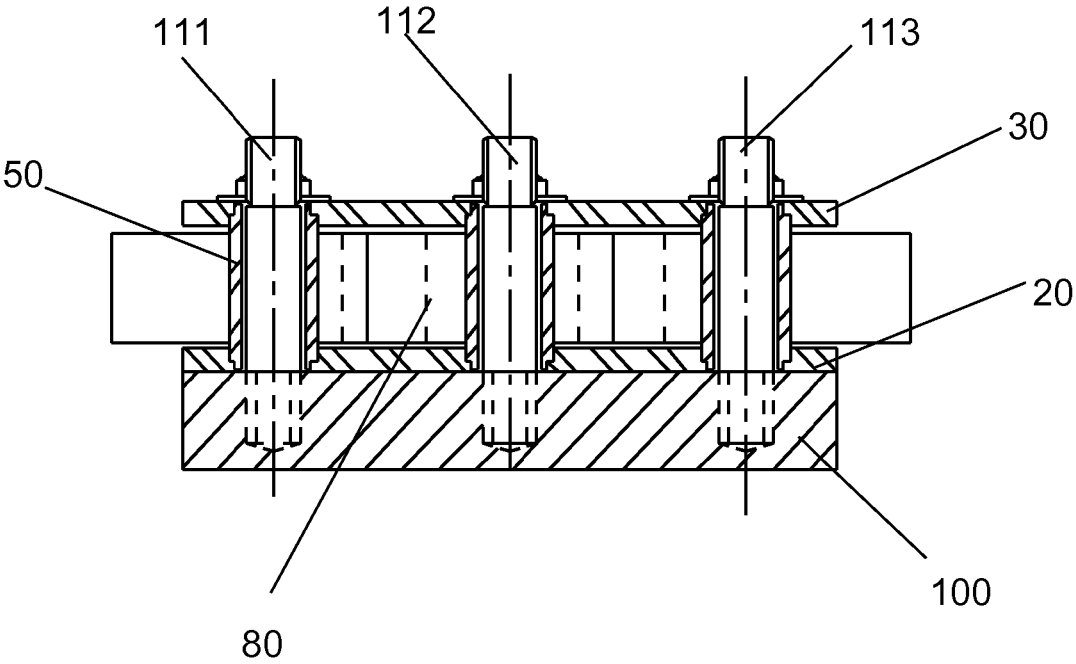
FIG. 13 is a simplified cross sectional elevation of FIG. 12, but with the stepped spacers added.
Figure 14:
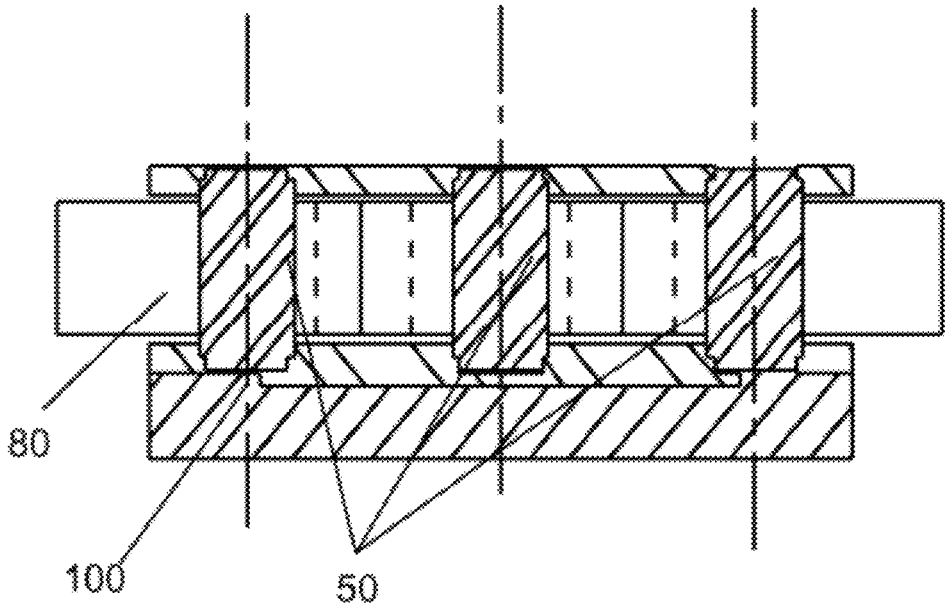
FIG. 14 is a simplified cross sectional elevation with solid spacers and with the lower vane ring employing a stepped pilot location.

As can be more clearly seen in the exploded view of FIG. 7, the spacer (50) is a stepped spacer inserted at a first end (52) into a first counter bore (22) formed in the lower support ring (20) and at a second end (54) into a second counter bore (32) formed in the upper support ring (30). The first and second counter bores (22), (32) can be formed as blind holes or through holes. The stepped spacer (50) has a central through hole formed therein for the fastener (42) to go through. The inside wall (51) of the spacer (50) surrounds the outside wall (43) of the fastener (42). The inside diameter of the through hole (51) is larger than the outer diameter of the fastener (43) such that the clearance is in the range of greater than 5% of the fastener shank diameter (43). The clearance is formed between the inside wall (51) of the stepped spacer (50) and the outside wall (43) of the fastener (42). This clearance is to offset any radial thermal expansion, or deformation imparted from the turbine housing. The stepped spacer (50) has a middle section (56) having a diameter larger than that of the first and second ends (52), (54), thus forming a step at each end.

Figure 15:
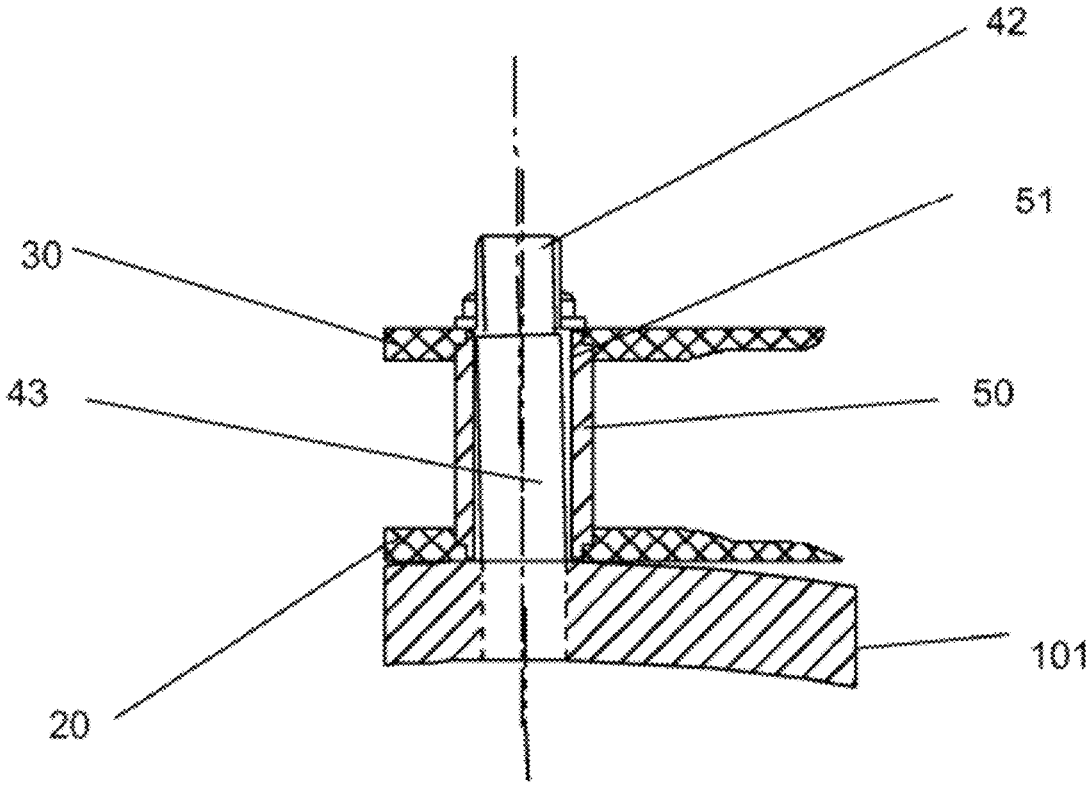
FIG. 15 is a simplified section of the stepped spacer showing that the deformation of the turbine housing does not cause conflict between the fastener and the spacer.

FIG. 15 is a magnified simple view of the geometry effect of distortion in the turbine housing mounting face (101). The fastener (42) moves in response to the distortion in the turbine housing mounting face (101). The clearance, (above) between the outer surface (43) of the fastener (42) and the inner wall (51) of the stepped spacer (50) allows the movement of the outer surface of the fastener (43) to not contact the inner wall of the spacer (51). This prevents a reactive stress in the lower and upper vane rings (20, 30), which would manifest itself as distortion in the upper and lower rings. Thus the vanes (80) can move freely with small clearances. This enables efficiencies losses, attributable to vane-cheek-to-vane-ring clearances, to be kept to a minimum.

The stepped structure enables the spacer to be securely mounted to both the upper and lower vane rings (20) and (30) to aid in assembly, while, with the counterbores (22) and (32) it determines the spacing between the upper and lower vane rings. This spacing, in concert with the vane height dimension, determines the clearance between vane and vane rings.

Figure 16:
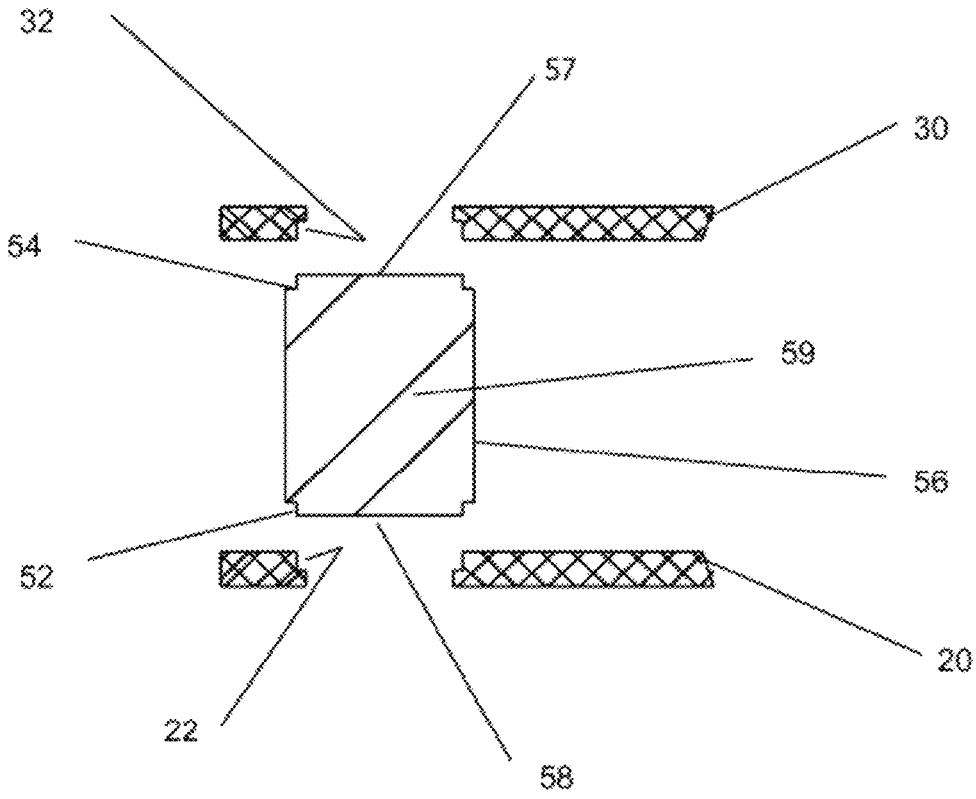
FIG. 16 is a simplified front elevation, cross sectional view, of a typical solid stud arrangement.
Figure 17:
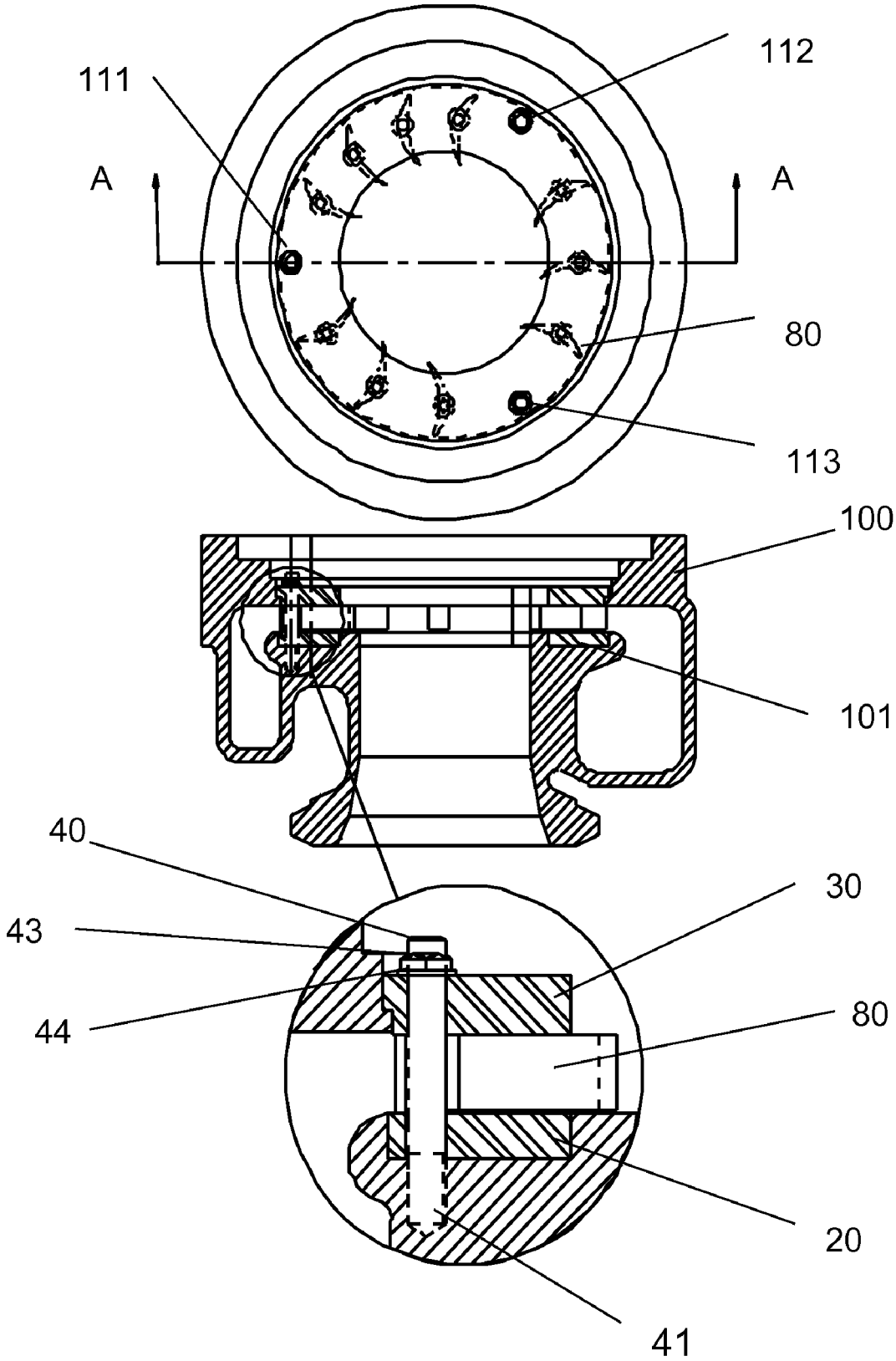
FIG. 17 is the plan view, with an elevation, and a magnified zone, of a typical fastener and non-stepped spacer arrangement in a turbine housing section.

Alternatively, a solid stepped spacer (59) FIG. 16 can be used to locate the upper and lower vane rings (20) and (30) with respect to each other. Each end (57, 58) of the stepped spacer is formed (52, 54) to fit into a detail (22, 32) formed in a corresponding vane ring. Solid stepped spacers can provide a cost advantage by allowing elimination of the costly through-hole. Also, by using solid stepped spacers, it is possible to eliminate the costly fasteners and facilitate the use of alternate means of fixation of the support rings. An embodiment of this invention using solid spacers employs a retaining ring to retain the vane ring assembly in the turbine housing, as disclosed in a co-pending application to the same assignee.

Figure 19:
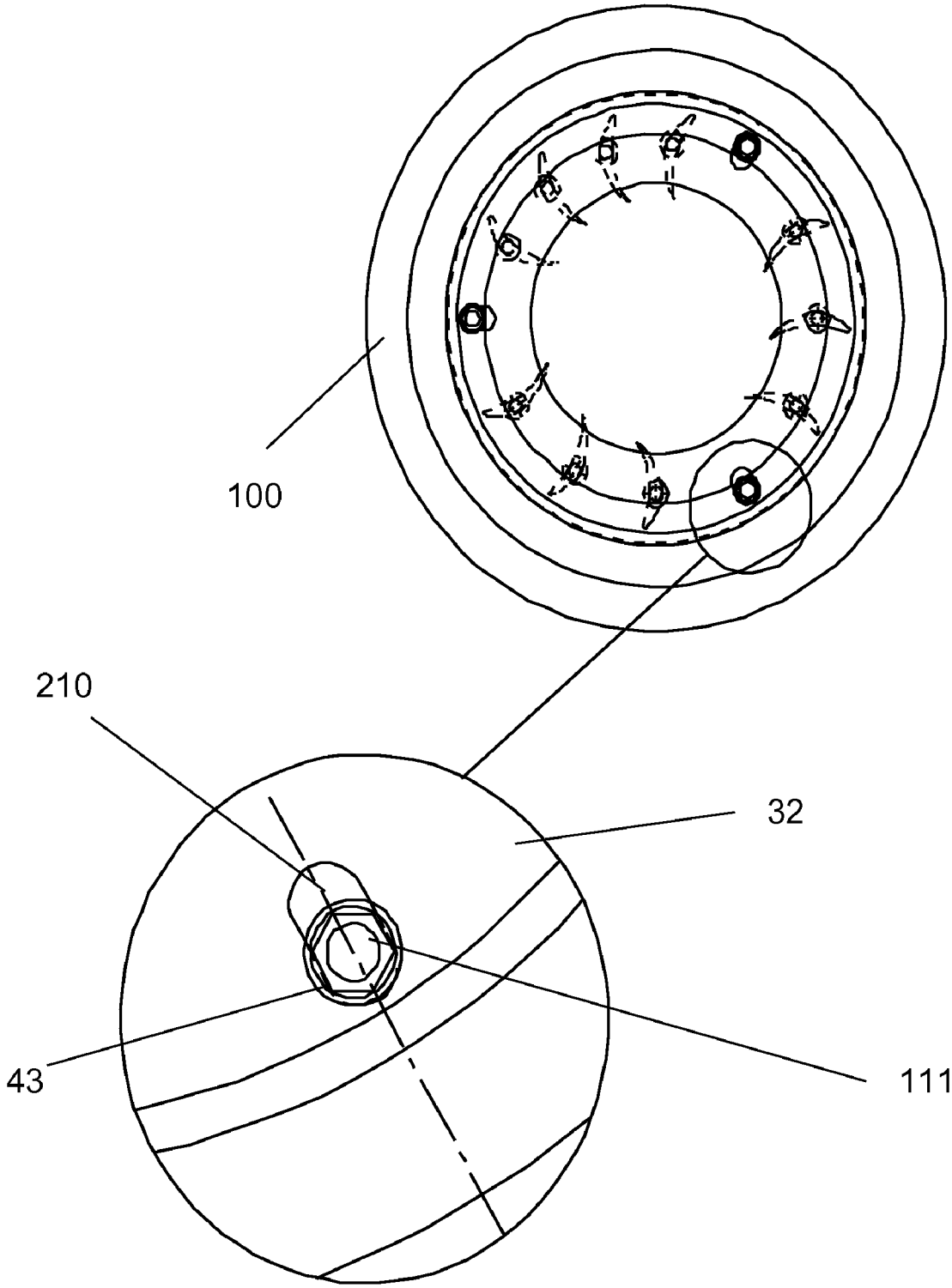
FIG. 19 is the plan view of the vane ring assembly showing a radial slotted hole for the fastener and spacer.

Another exemplary embodiment for the spacers and the lower and upper vane rings is shown in FIG. 19. Through holes, with steps for the stepped spacer (50) can be formed, centered on radials near the periphery of each of the vane rings. Preferably, the holes (210) have a slotted shape so that each of the vane rings, with respect to the spacer, can undergo radial thermal expansion while maintaining the spacing between the vane rings. To allow for non-radial thermal expansion, which is known to be the case (the unconstrained turbine housing tries to become oval) the slot, with its mating step for the contoured fastener head could assume a curved shape. It is assumed that the upper vane ring would have slotted holes, matching those in the lower vane ring.

Figure 20:
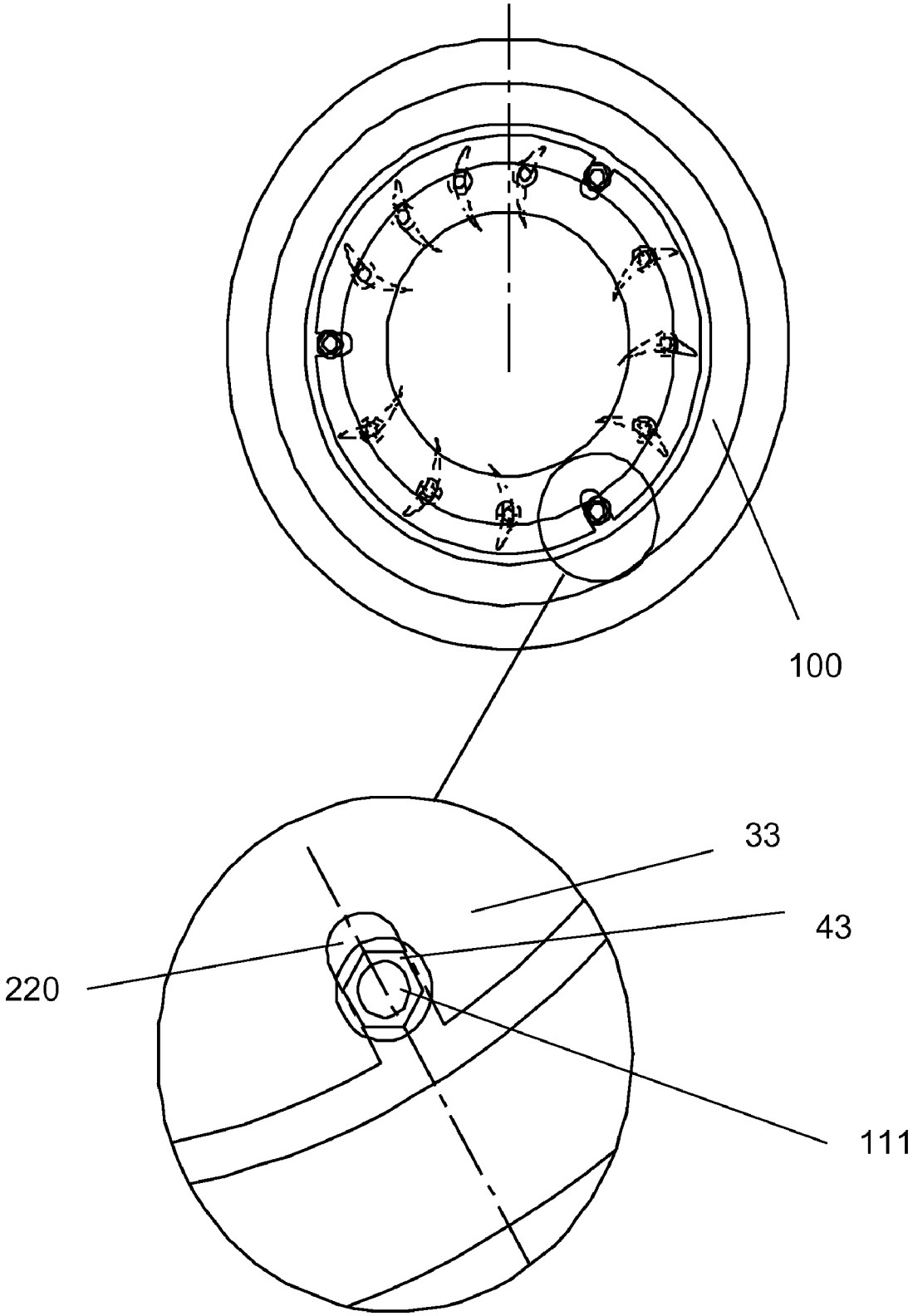
FIG. 20 is the plan view of the vane ring assembly showing a radial slotted hole, open to the periphery of the vane ring, for the fastener and spacer.
Figure 21:
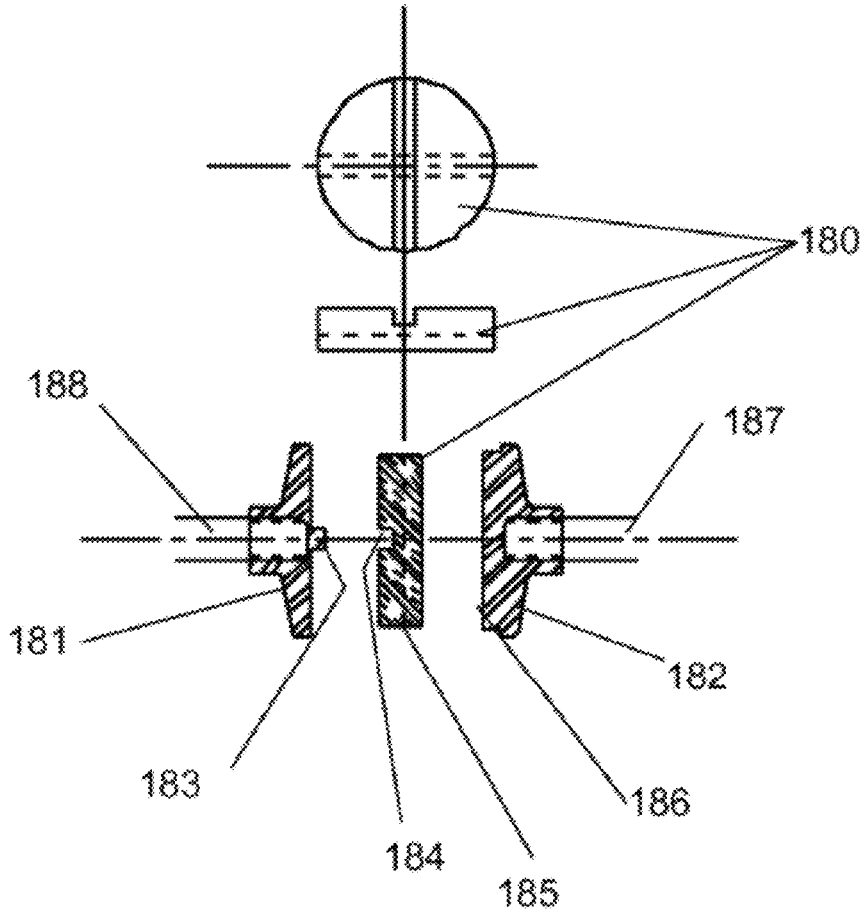
Fig. 21 Prior Art
FIG. 21 is a sketch of a coaxial cross key coupler in common use.

Another exemplary embodiment for the connection between the spacers and the lower and upper vane rings is shown in FIG. 20. Holes (220), with steps for the profiles fastener, can be formed, centered on radials, near the periphery of each of the support rings and can be open along a circumference of each of the rings. Preferably, the holes (220) have a slotted shape so that each of the vane rings, with respect to the spacer, can undergo radial thermal expansion while maintaining the spacing between the vane rings, with no deformation in the vane ring. To allow for non-radial thermal expansion, which is known to be the case (the unconstrained turbine housing tries to become oval) the slot, with its mating step for the contoured fastener head could assume a curved shape.

The LVR and UVR can have either both round, or slotted holes, with stepped locations for the stepped spacer, or any combination thereof Referring back to the spacers (50, 59), which are used to control the spacing of the vane rings. Any number of locating members, and fasteners, can be used. In the exemplary embodiment three locating members (either 50 or 59) are spaced about the vane rings. In a preferred embodiment, the locating members are fit into their locations formed in the vane rings and the assembly located in the turbine housing (100) with any number of locating fasteners.

The spacers have a cylindrical shape, although the present disclosure contemplates the use of other shapes for the locating members, including the aerodynamic forms. The particular size, shape, number, and configuration of spacers can be chosen based on a number of factors including ease of assembly, excitation of the turbine wheel, stiffness and thermal deformation control. The choice of material for the spacers can be based on several factors, including thermal coefficient of expansion, machinability, corrosion resistance, cost, strength and durability.

The vane ring assembly can be connected to the housing, such as a rigid connection along only the axial direction, by various structures and techniques while still allowing the spacer to provide for radial thermal growth and deflection. The exemplary embodiments above have been described with respect to a vane ring assembly that adjusts vane position to control exhaust gas flow to the turbine rotor. However, it should be understood that the present disclosure contemplates providing a system or method of connection for a vane ring assembly that controls flow of a compressible fluid to the compressor rotor, which because of the lower temperatures, is a much more simple case. The present disclosure further contemplates the use of the assembly system described herein for a turbocharger having both variable turbine geometry and variable compressor geometry. Such an arrangement for variable compressor geometry can have many of the components described above for the variable turbine geometry, as well as other components known in the art.

While the invention has been described by reference to a specific embodiment chosen for purposes of illustration, it should be apparent that numerous modifications could be made thereto by those skilled in the art without departing from the spirit and scope of the invention.

We claim:

1. A vane ring assembly, comprising:

a lower vane ring (20);

an upper vane ring (30);

one or more guide vanes (80) pivotably mounted at least partially between said lower and upper vane rings;

one or more fasteners for fastening said upper vane ring relative to said lower vane ring;

at least one spacer (50) positioned between said lower and upper vane rings (20, 30) for maintaining a distance between said lower and upper vane rings (20, 30), wherein said spacer is a stepped spacer with a spacer body section (56) with a spacer outer diameter, and with first and second ends (52, 54) having outer diameters smaller than said spacer body section (56) outer diameter, and wherein at least said first and second ends (52, 54) of said spacer (50) are seated in first and second counter bores (22, 32) formed in said lower and upper vane rings (20, 30).

2. The vane ring assembly as in claim 1, wherein at least one of said first counter bore (22) and second counter bore (32) are stepped, and wherein the associated stepped spacer end is matingly received in said stepped counter bore.

3. The vane ring assembly as in claim 1, wherein at said first and second counter bores (22, 32) are stepped, and wherein the associated stepped spacer ends is matingly received in said stepped counter bores.

4. The vane ring assembly as in claim 1, wherein said one or more fasteners has a shank with an outer diameter, wherein said stepped spacer includes a coaxial bore with an internal diameter, wherein said fastener shank extends through said bore in said stepped spacer, and wherein said spacer bore internal diameter ($D_I$) is at least 5% greater than said fastener shank outer diameter ($D_O$).

5. The vane ring assembly as in claim 1, wherein said upper and lower vane rings include circular spacer bores and radially elongate fastener bores (210, 220), wherein each spacer bore receives one spacer end, and wherein each fastener bore has a fastener extending through it.

6. The vane ring assembly as in claim 5, wherein said fasteners axially secure said upper and lower vane rings to said turbine housing.

7. The vane ring assembly as in claim 6, wherein said fasteners comprise bolts (111) and nuts (43), and wherein the load of said nuts on said upper and lower vane rings permits radial thermal expansion and contraction of said vane rings along said radially elongate bores.

8. The vane ring assembly as in claim 7, further including a washer (40) arranged between the nut (44) and a vane ring surface.

9. The vane ring assembly as in claim 5, wherein said radially elongate bores are open at an outer circumference of said vane rings.

* * * * *